US007631583B2

(12) United States Patent
Hsieh

(10) Patent No.: US 7,631,583 B2
(45) Date of Patent: Dec. 15, 2009

(54) TORQUE WRENCH WITH AN INPUT MODULE

(75) Inventor: Chih-Ching Hsieh, No. 367, Pei Yang Rd., Feng Yuan, Taichung, Taichung Hsien (TW) 42084

(73) Assignee: Chih-Ching Hsieh, Feng Yuan, Taichung (TW)

( * ) Notice: Subject to any disclaimer, the term of this patent is extended or adjusted under 35 U.S.C. 154(b) by 0 days.

(21) Appl. No.: 12/188,199

(22) Filed: Aug. 7, 2008

(65) Prior Publication Data

US 2009/0120247 A1 May 14, 2009

Related U.S. Application Data

(63) Continuation-in-part of application No. 11/938,784, filed on Nov. 13, 2007, now abandoned.

(51) Int. Cl.
*B25B 23/14* (2006.01)
*B25B 23/144* (2006.01)

(52) U.S. Cl. ..... 81/467; 81/479

(58) Field of Classification Search ..... 81/467, 81/477, 479–483; 702/41; 73/862.21–862.23
See application file for complete search history.

(56) References Cited

U.S. PATENT DOCUMENTS

| | | | | | |
|---|---|---|---|---|---|
| 2,205,510 | A * | 6/1940 | Wolfram | 73/862.22 |
| 2,440,683 | A * | 5/1948 | Hattan | 81/479 |
| D257,626 | S * | 12/1980 | Grabovac | D8/24 |
| 7,044,036 | B1 * | 5/2006 | Salazar et al. | 81/483 |
| 7,107,884 | B2 * | 9/2006 | Cutler et al. | 81/479 |
| 7,370,539 | B2 * | 5/2008 | Gharib et al. | 73/862.21 |
| 2004/0255733 | A1 * | 12/2004 | Reynertson, Jr. | 81/467 |

* cited by examiner

*Primary Examiner*—David B Thomas
(74) *Attorney, Agent, or Firm*—CKC & Partners Co., Ltd.

(57) ABSTRACT

An input module for a torque wrench includes a hollow shank having a first end and a second end. A driving head is partially received in the first end of the hollow shank and has a driving stub laterally disposed thereon. A sensing unit is mounted in the driving head. A grip is disposed on the second end of the hollow shank. An input mechanism includes a display device, multiple rotary rings and a processing unit. The multiple rotary rings are co-axially and rotatably mounted on the outer periphery of the hollow shank adjacent to the grip and electrically connected to the processing unit for inputting an alarm torque value to the processing unit.

8 Claims, 6 Drawing Sheets

TORQUE WRENCH WITH AN INPUT MODULE

CROSS-REFERENCE TO RELATED APPLICATION

This application is a Continuation-In-Part Application of Ser. No. 11/938,784, filed 13 Nov. 2007, and entitled "THE TORSION SETTING STRUCTURE OF SPANNER", now pending.

BACKGROUND OF THE INVENTION

1. Field of the Invention

The present invention relates to a torque wrench, and more particularly to a torque wrench with an input module that has multiple rotary rings for inputting an alarm torque value.

2. Description of Related Art

A conventional torque wrench in accordance with the prior art includes a shank having a first end and a second end. A wrench head is disposed on the first end of the shank and is configured to engage the workpiece. A grip is disposed on the second end of the wrench head. A user interface is carried by the shank and includes a housing, a digital display, and an input device for inputting a preset torque value. A torque sensing element is carried by the wrench head and is electrically connected to the display device. The display device is rotatable relative to the wrench head. The input device includes an increment bottom and a decrement bottom for sequentially increasing/decreasing input value.

However, the conventional input device in accordance with the prior art is easily touched in a disorderly working environment. Moreover, a user can accidentally slip to touch the bottom of the input device and change the input value. Besides, it is very slow to input a value for operating conventional input device. The value should be sequentially increased/decreased for inputting a specific value.

The present invention has arisen to mitigate and/or obviate the disadvantages of the conventional input module for a torque wrench.

SUMMARY OF THE INVENTION

The main objective of the present invention is to provide an improved torque wrench with an input module that has multiple rotary rings for inputting an alarm torque value.

To achieve the objective, the torque wrench in accordance with the present invention comprises a hollow shank having a first end and a second end. A driving head is partially received in the first end of the hollow shank and has a driving stub laterally disposed thereon for adapting to drive a workpiece. A sensing unit is mounted in the driving head for gauging a torque value. A grip is disposed on the second end of the hollow shank opposite to the driving head. An input mechanism includes a display device, multiple rotary rings and a processing unit. The display device is disposed on an outer periphery of the hollow shank and electrically connected to the processing unit. The multiple rotary rings are co-axially and rotatably mounted on the outer periphery of the hollow shank adjacent to the grip and electrically connected to the processing unit for inputting an alarm torque value to the processing unit. The processing unit is received in the hollow shank and electrically connected to the sensing unit, the display device, and the multiple rotary rings for receiving the values, comparing with the values and controlling the display device.

The multiple rotary rings of the input module of the present invention provide a rotatably operation such that a user can respectively rotate the multiple rotary rings for quickly inputting every digits corresponding to the alarm torque value. The rotary rings of the present invention is sleeved on the hollow shank for preventing a preset alarm torque value getting change from accidentally touching such that a user should properly put a finger on one of the multiple rotary rings and rotates it, therefore, the preset alarm torque value can be changed.

Further benefits and advantages of the present invention will become apparent after a careful reading of the detailed description with appropriate reference to the accompanying drawings.

DETAILED DESCRIPTION OF THE INVENTION

Figure 1:
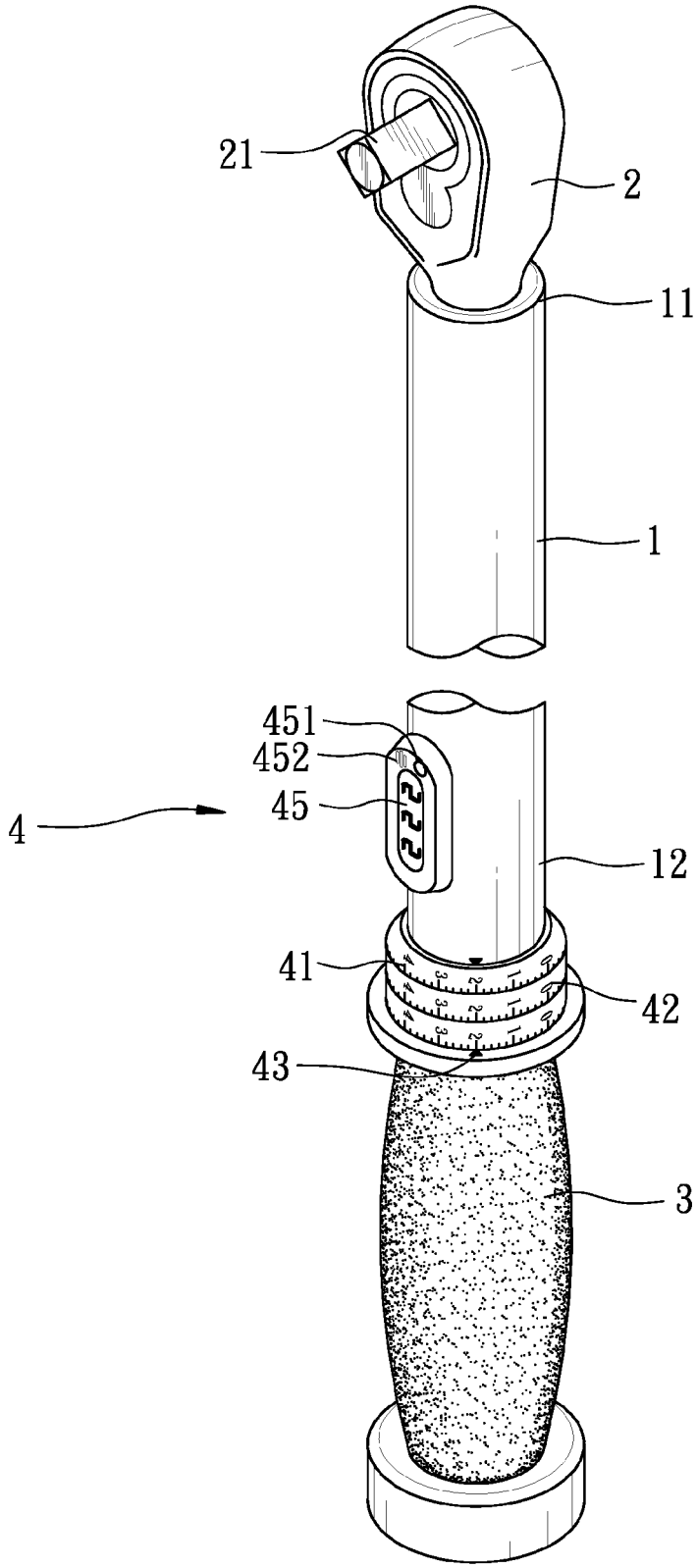
FIG. 1 is a perspective view of a torque wrench with an input module in accordance with the present invention.
Figure 2:
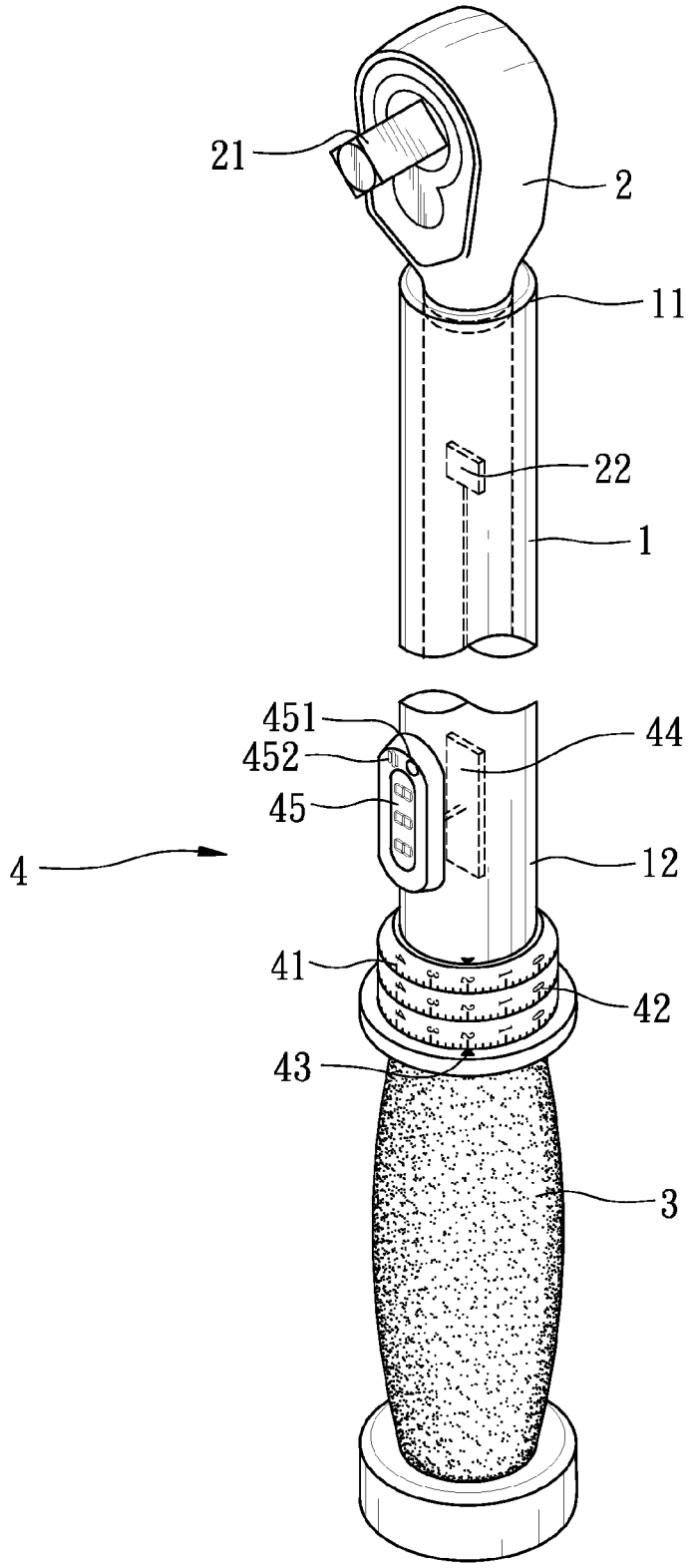
FIG. 2 is a perspective view of the torque wrench in FIG. 1 for showing the sensing unit and the processing unit.
Figure 3:
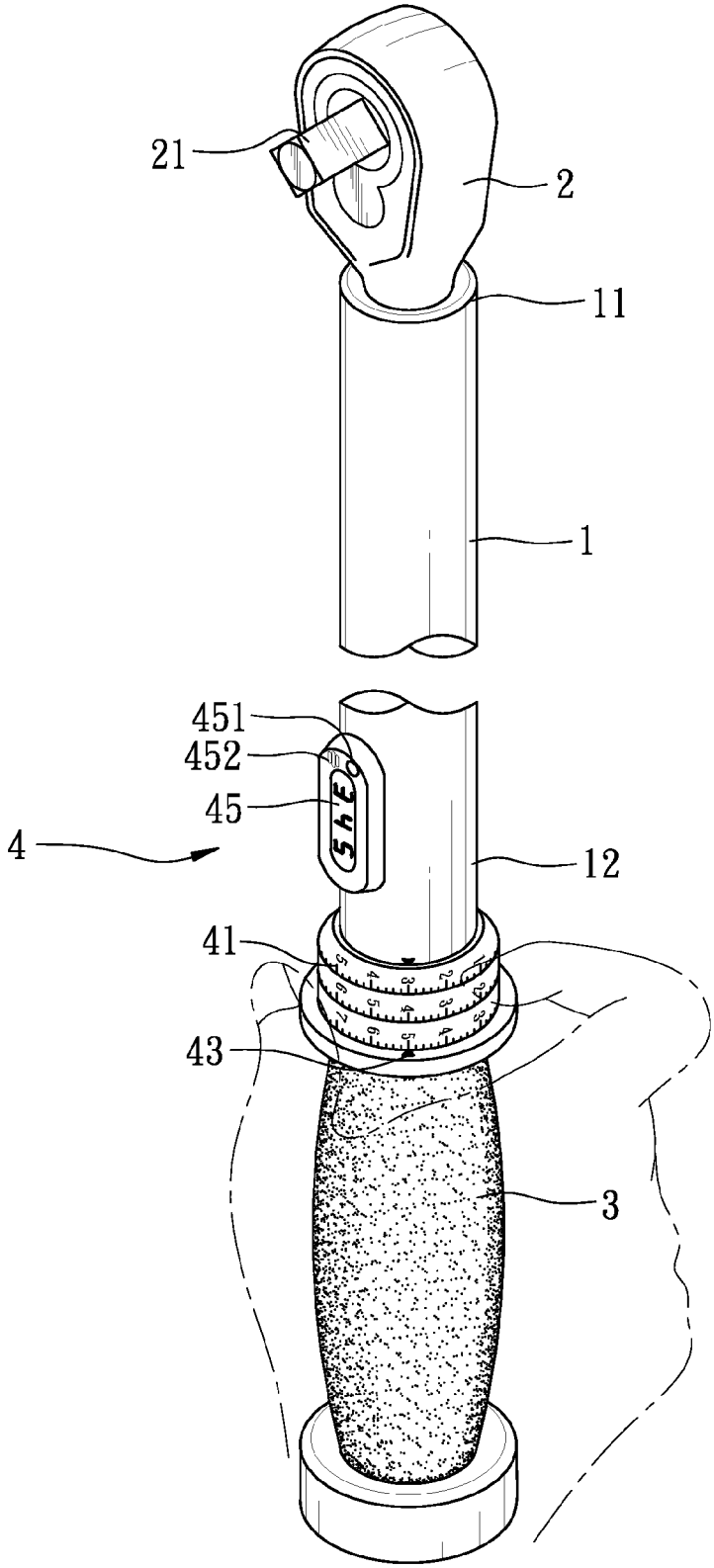
FIG. 3 and FIG. 4 are operational views of the torque wrench in FIG. 1.
Figure 4:
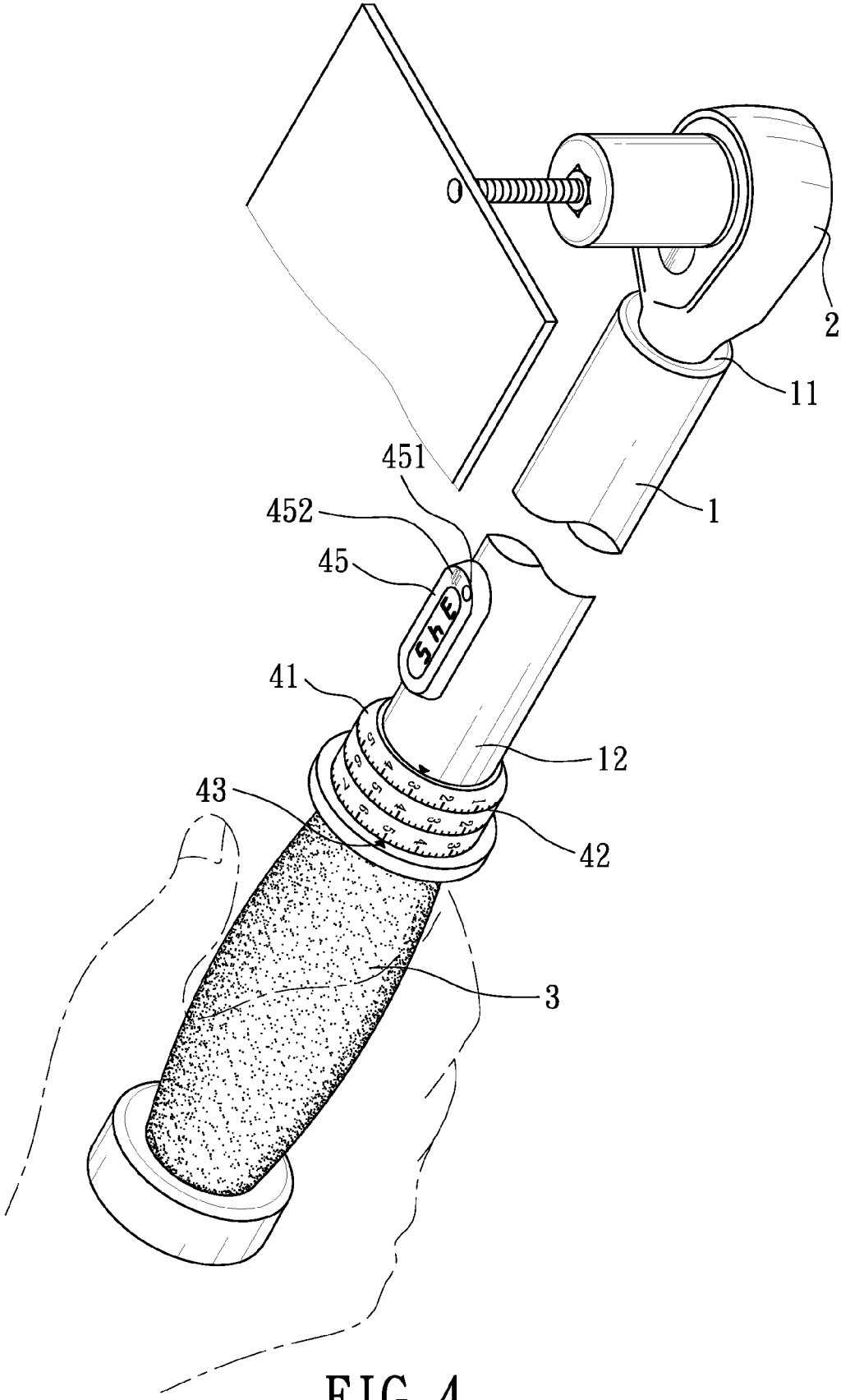
Figure 5:
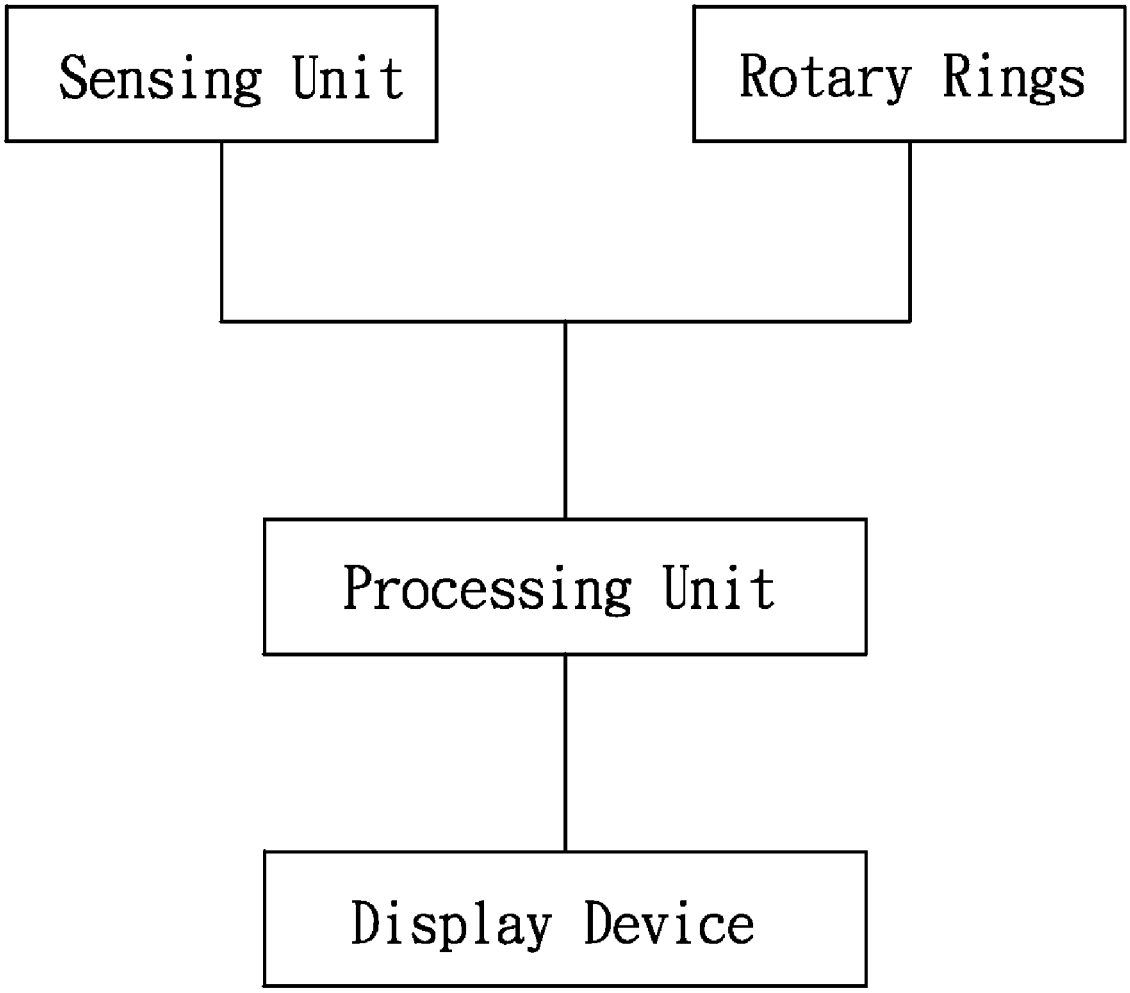
FIG. 5 is a flow char of torque wrench in accordance with the present invention.

Referring to the drawings and initially to FIGS. 1-5, an input module for a torque wrench in accordance with the present invention comprises a hollow shank (1) having a first end (11) and a second end (12). A driving head (2) is partially received in the first end (11) of the hollow shank (1) and has a driving stub (21) laterally mounted thereon for adapting to drive a workpiece, such as a socket, a screw, a nut, and an extension, etc. A sensing unit (22) is mounted in the driving head (2) for gauging a torque value from the driving stub (21) during operating. In the preferred embodiment of the present invention, the sensing unit (22) is received in a part of the driving head (2) which is received in the hollow shank (1) for precisely gauging the torque value when the torque wrench is operated.

A grip (3) is disposed on the second end (12) of the hollow shank (1) opposite to the driving head (2). An input mechanism (4) is disposed near a middle of the hollow shank (1) and includes a display device (45), multiple rotary rings (41), and a processing unit (44). The display device (45) is mounted on an outer periphery of the hollow shank (1) and electrically connected to the processing unit (44) that is disposed in the hollow shank (1). In the preferred embodiment of the present invention, the display device (45) includes an alphanumeric liquid crystal display (Alphanumeric LCD), a buzzer (452), and a light emitting diode (451) (LED). The multiple rotary rings (41) are co-axially and rotatably sleeved on the outer periphery of the hollow shank (1) adjacent to the grip (3) and electrically connected to the processing unit (44) for inputting an alarm torque value. In the preferred embodiment of the present invention, the quantity of the multiple rotary rings (41) is three. The three rotary rings respectively correspond to one's digit, tenth digit, and hundredth digit of the alarm torque value that is shown on the display device (45). A series of scales (42) is radially disposed on each of the multiple rotary rings (41) for showing the input value of the multiple rotary rings (41). Two indicators are respectively disposed on both sides of the multiple rotary rings (41). In the preferred embodiment of the present invention, an indicator (43) is disposed on the outer periphery of the hollow shank (1) and the other indicator (43') is disposed on an outer periphery of the grip (3) for pointing out the numerals of the series of scales (42). Therefore, a user may respectively rotate the multiple rotary rings (41) for transmitting the alarm torque value to the processing unit (44). The processing unit (44) is received in the hollow shank (1) and electrically connected to the sensing unit (22), the display device (45), and the multiple rotary rings (41). In the preferred embodiment of the present invention, the processing unit (44) includes a printed circuit board (PCB) and a processor electrically mounted on the printed circuit board.

A user can respectively rotate the multiple rotary rings (41) for inputting the alarm torque value to the processing unit (44) before operating. The processing unit (44) receives the alarm torque value and transmits a signal to the display device (45) for showing the alarm torque value on the display device (45). The sensing unit (22) transmits a torque value to the processing unit (44) when the torque wrench is operated and the sensing unit (22) gauges the torque value of the torque wrench. The processing unit (44) receives the torque value and transmits a signal to the display device (45) for showing the present torque value when the torque wrench is operated. The processing unit (44) compares the alarm torque value with the torque value. The processing unit (44) transmits a signal to the display device (45) for showing a warning message, such as a beep of the buzzer (452), a flash of the light emitting diode (451), or a color change of the liquid crystal display when the present torque value reaches 90% of the alarm torque value. The processing unit (44) transmits a signal to the display device (45) for showing another warning message, such as a loud beep of the buzzer (452), a flash of different color of the light emitting diode (451), another color change of the liquid crystal display, or shutdown the torque wrench when the present torque value is greater than the alarm torque value.

Figure 6:
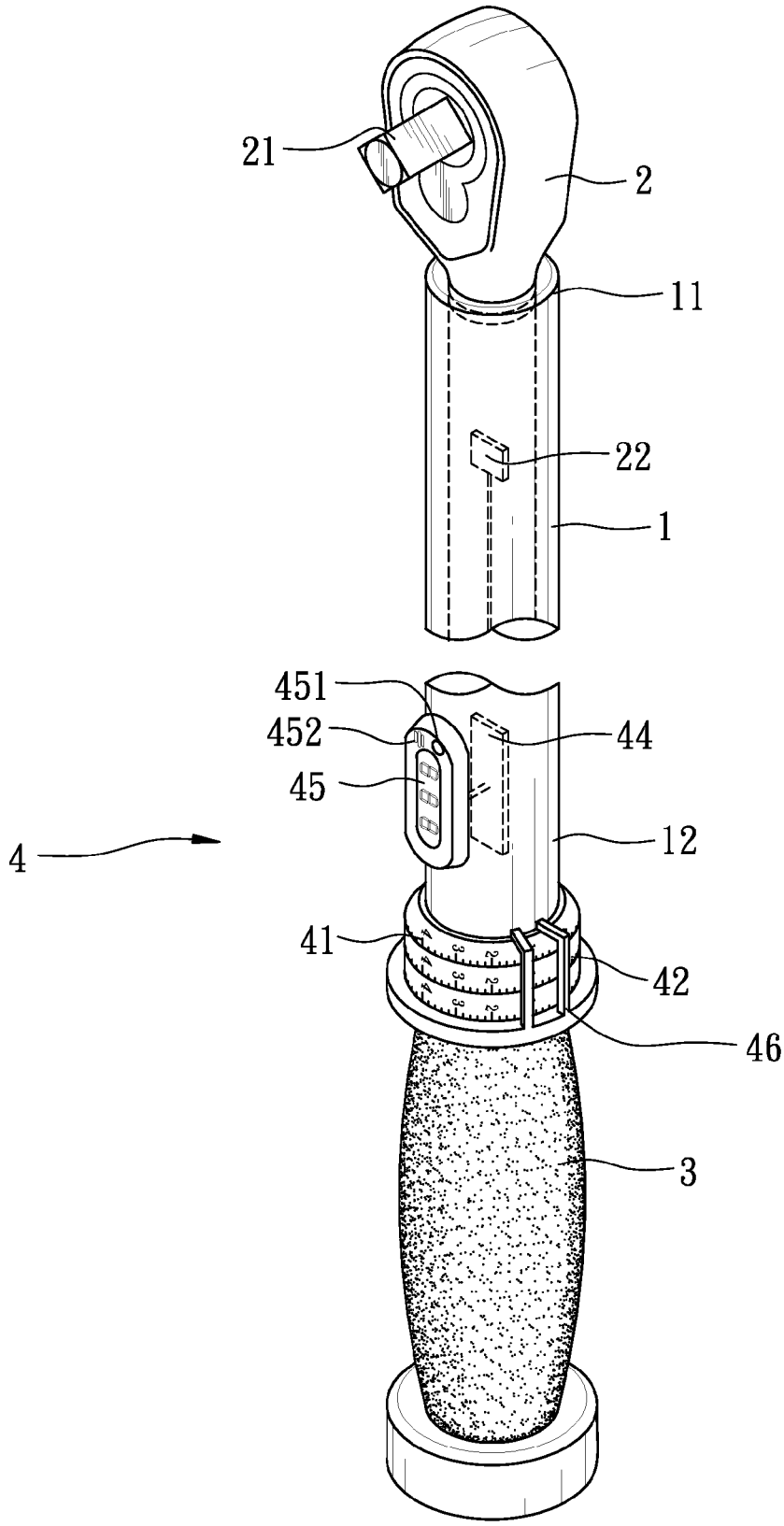
FIG. 6 is a partially perspective view of a second embodiment of the torque wrench in accordance with the present invention.

With reference to FIG. 6 that shows a second embodiment of the present invention, two indicants (46) are mounted across the multiple rotary rings (41). Each of the indicants (46) has a first end mounted on the hollow shank (1) and a second end mounted on the grip (3) for linearly aligning the numerals of the multiple rotary rings (41) between the two indicants (46) to point out the numerals of the series of scales (42).

Although the invention has been explained in relation to its preferred embodiment, it is to be understood that many other possible modifications and variations can be made without departing from the spirit and scope of the invention as hereinafter claimed.

What is claimed is:

1. An input module for a torque wrench comprising:

a hollow shank having a first end and a second end;

a driving head partially received in the first end of the hollow shank and having a driving stub laterally disposed thereon for adapting to drive a workpiece, a sensing unit mounted in the driving head for gauging a torque value from the driving stub during operating;

a grip disposed on the second end of the hollow shank opposite to the driving head;

an input mechanism disposed near a middle of the hollow shank and including:

a display device disposed on an outer periphery of the hollow shank and electrically connected to the processing unit disposed in the hollow shank;

multiple rotary rings co-axially and rotatably mounted on the outer periphery of the hollow shank adjacent to the grip and electrically connected to the processing unit for inputting an alarm torque value to the processing unit; and a processing unit received in the hollow shank and electrically connected to the sensing unit, the display device, and the multiple rotary rings for receiving the values, comparing torque value with the alarm torque value and controlling the display device;

whereby the processing unit compares the alarm torque value with the torque value and the display device is controlled by the processing unit for showing a warning message on the display device when the torque value is close to the alarm torque value.

2. The input module for a torque wrench as claimed in claim 1 further comprising a series of scales radially disposed on each of the multiple rotary rings for showing the input values of the multiple rotary rings.

3. The input module for a torque wrench as claimed in claim 2 further comprising an indicator disposed on the outer periphery of the hollow shank for pointing out the numerals of the series of scales.

4. The input module for a torque wrench as claimed in claim 2 further comprising an indicator disposed on an outer periphery of the grip for pointing out the numerals of the series of scales.

5. The input module for a torque wrench as claimed in claim 2 further comprising an indicant mounted across the multiple rotary rings, the indicant having a first end mounted on the hollow shank and a second end mounted on the grip for linearly aligning the numerals of the multiple rotary rings to point out the numerals.

6. The input module for a torque wrench as claimed in claim 1, wherein the display device includes a liquid crystal display, a buzzer, and a light emitting diode for presenting an alarm message.

7. The input module for a torque wrench as claimed in claim 1, wherein the processing unit includes a printed circuit board and a process electrically mounted on the printed circuit board.

8. The input module for a torque wrench as claimed in claim 1, wherein the quantity of the multiple rotary rings is three, the three rotary rings respectively corresponding to one's digit, tenth digit, and hundredth digit of the alarm torque value shown on the display device.

* * * * *